United States Patent [19]

Gerding et al.

[11] 4,357,125

[45] Nov. 2, 1982

[54] RAILWAY INGOT MOLD CAR

[75] Inventors: Charles C. Gerding; Stephen M. Rechtorik, both of Pittsburgh, Pa.

[73] Assignee: Jones & Laughlin Steel Corporation, Pittsburgh, Pa.

[21] Appl. No.: 182,246

[22] Filed: Aug. 28, 1980

[51] Int. Cl.[3] ..... B60P 3/00; B61D 3/16; B61F 1/14

[52] U.S. Cl. ..... 410/44; 105/413; 105/418; 410/2

[58] Field of Search ..... 105/238 R, 355, 413, 105/418, 422, 453, 454; 410/2, 44, 46

[56] References Cited

U.S. PATENT DOCUMENTS

| | | | |
|---|---|---|---|
| 684,936 | 10/1901 | Hoerr | 105/413 |
| 851,102 | 4/1907 | Owens | 105/413 |
| 1,917,314 | 7/1933 | Moir | 410/2 |
| 1,969,844 | 8/1934 | Heath | 105/454 |
| 2,331,416 | 10/1943 | Miller, Sr. | 410/2 |
| 3,209,708 | 10/1965 | Spence | 105/454 |

*Primary Examiner*—Robert B. Reeves
*Assistant Examiner*—Howard Beltran
*Attorney, Agent, or Firm*—John Stelmah

[57] ABSTRACT

An ingot mold buggy for carrying steel ingots and molds which buggy is of improved construction to resist damage due to excessive impact loading such as that which might be encountered by dropping a mold and a contained ingot on the buggy.

3 Claims, 8 Drawing Figures

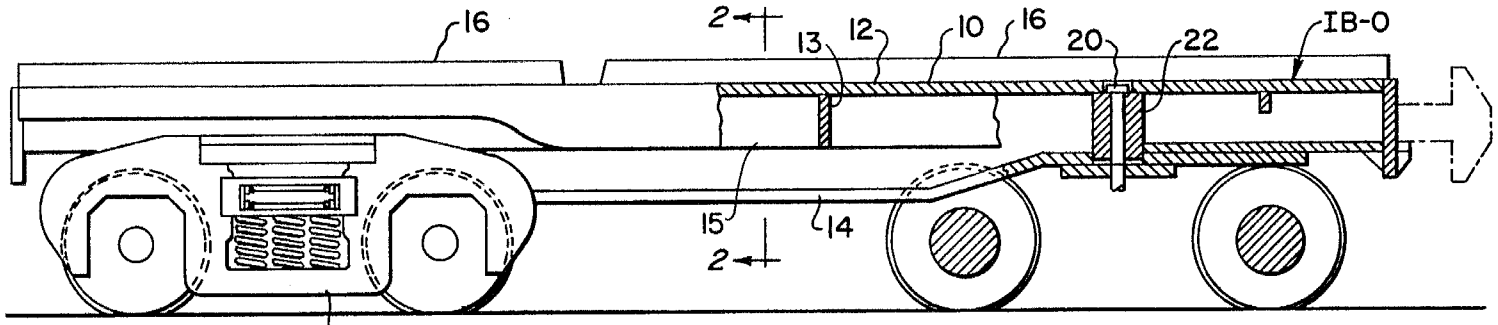
Fig. 1-Prior Art
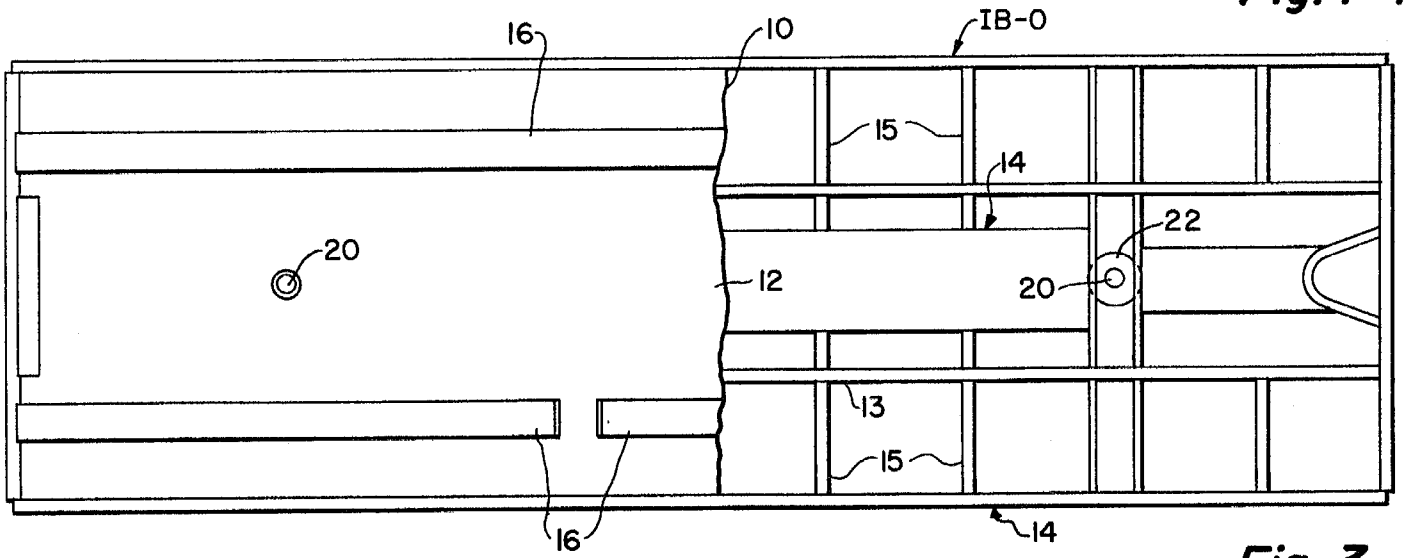
Fig. 3-Prior Art
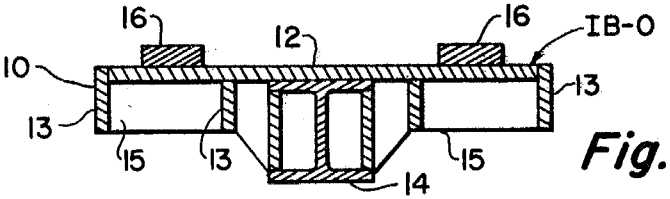
Fig. 2-Prior Art

RAILWAY INGOT MOLD CAR

BACKGROUND OF THE INVENTION

1. Field of the Invention

This invention relates to ingot mold cars, commonly referred to as buggies in the steel industry, for transporting ingot molds and/or the ingots formed therein.

After the molten metal has been poured into molds and has solidified as ingots in the molds, the drag of molds with the ingots therein is moved to the strippers. The strippers are usually overhead cranes. In the case of molds of the big end down design, which have open bottom ends, the cranes lift the molds individually from the ingot buggy while a plunger forces the ingot downwardly against the platform of the buggy. In the case of molds of the big-end-up design, which have open tops, the cranes lift the ingot from the mold while holding the mold down against the buggy. After the big-end-down molds or big-end-up ingots are lifted away they are transferred to other buggies. Frequently, there occur "stickers", i.e., ingots which cannot be readily released from the molds. Such stickers usually occur in molds whose inside surfaces have eroded unevenly and wherein some of the molten metal fills in the eroded areas and form sprues extending into the sidewalls of the molds. In such events, it is a very common practice to lift the mold and the ingot several feet above the buggy and drop them upon the deck of the buggy. Although this loosens the ingots from the mold, such practice is very damaging to the buggy and shortens its useful life. The dropping of the combined ingot and mold produces a large amount of foot pounds of energy, which energy must be absorbed by deflection of the various components of the buggy in order to stop the free fall of the combination.

2. Prior Art

In a typical prior art ingot mold buggy there is a single deck frame supported by substructure which includes a pair of center thrust bearings and bolster assemblies for cushioning dynamic load effects upon the wheel axle journals. In such buggy the weight of the carried load, the weight of the deck frame, and the weight of the substructure, as well as any impact loading, are all imposed on the center thrust bearings. In turn the load on each of these bearings is borne by a truck frame which carries wheels of the buggy and the bolster assemblies. Each of the bolster assemblies comprises a series of helical compression type springs which transmits the load downwardly to the wheel journal bearings.

Generally, any sizable loading will cause the helical springs to deflect. If a sufficiently great loading, such as a dynamic one caused by dropping an ingot mold and a contained ingot, is imposed the springs will be momentarily completely compressed to the point where they form solid cylinders. Any loading greater than that required to completely close the coils of the springs will result in increased deflection of other components of the buggy. Since the other components are usually of rigid construction there need not occur great physical deflection before such components will be strained beyond the elastic limit of the material of which they are comprised and take on a permanent set and irreversible deformation. Such deformation ultimately destroys the useful life of the buggy.

OBJECTS AND SUMMARY OF THE INVENTION

It is a primary object of this invention to provide a new and improved construction of an ingot buggy.

It is a further object of this invention to provide a rugged construction of an ingot buggy which can better withstand deformation.

It is another object of this invention to provide an ingot buggy which will more effectively withstand dynamic loading and decrease failures contributable to increased dynamic loading as compared to prior art constructions.

In accordance with this invention, an ingot buggy is provided of multiple deck construction in an arrangement wherein at least one of the decks responds to dynamic loading in a mode akin to that of a double flat elliptical spring. Such an arrangement diminishes the transmission of the shock of impact loading to the king pins and the center thrust bearings connecting the bottom deck frame to the truck frame. In a preferred embodiment a top deck comprises a pair of mutually opposing longitudinal side frame members joined together at or near their ends by cross-members which rest upon, but are not securely fastened to, the bottom deck. Additional cross-ties may be provided between the longitudinal side frame members of the top deck, however, it is preferred that such additional cross-ties not rest upon the lower deck. It is also preferred that the top deck longitudinal side frame members extend outboard of the lower deck frame when the top and lower decks are in assembled relation to each other.

In the described preferred embodiment the upper deck is suspended by its extreme ends from the lower deck in order to maximize the deflection of the upper deck, when subjected to any heavy applied loading, such that the upper deck will bow slightly and thus maximize the energy adsorption of and deter the transmission of the impact of the loading forces to other components of the buggy. As a consequence, the lower deck accepts the impact loading at its extreme ends and if the loading is substantial enough the lower deck will bow in a direction opposite to the bow of the upper deck and thus create what may be described as a double elliptical spring.

DESCRIPTION OF THE DRAWING

The invention will be more fully understood and further objects and attendant advantages will become more apparent when reference is made to the following detailed description of prior art and of preferred embodiments and to the accompanying drawings in which:

FIG. 1 is a side elevational view, partially in cross-section, of a prior art ingot buggy frame, with the trucks, bolsters and a coupling (indicated in phantom lines);

FIG. 2 is a cross-sectional view taken along line 2—2 of FIG. 1;

FIG. 3 is a plan view of the buggy frame shown in FIG. 1;

DESCRIPTION OF PRIOR ART

Figures 4, 5, 6, 7, 8:
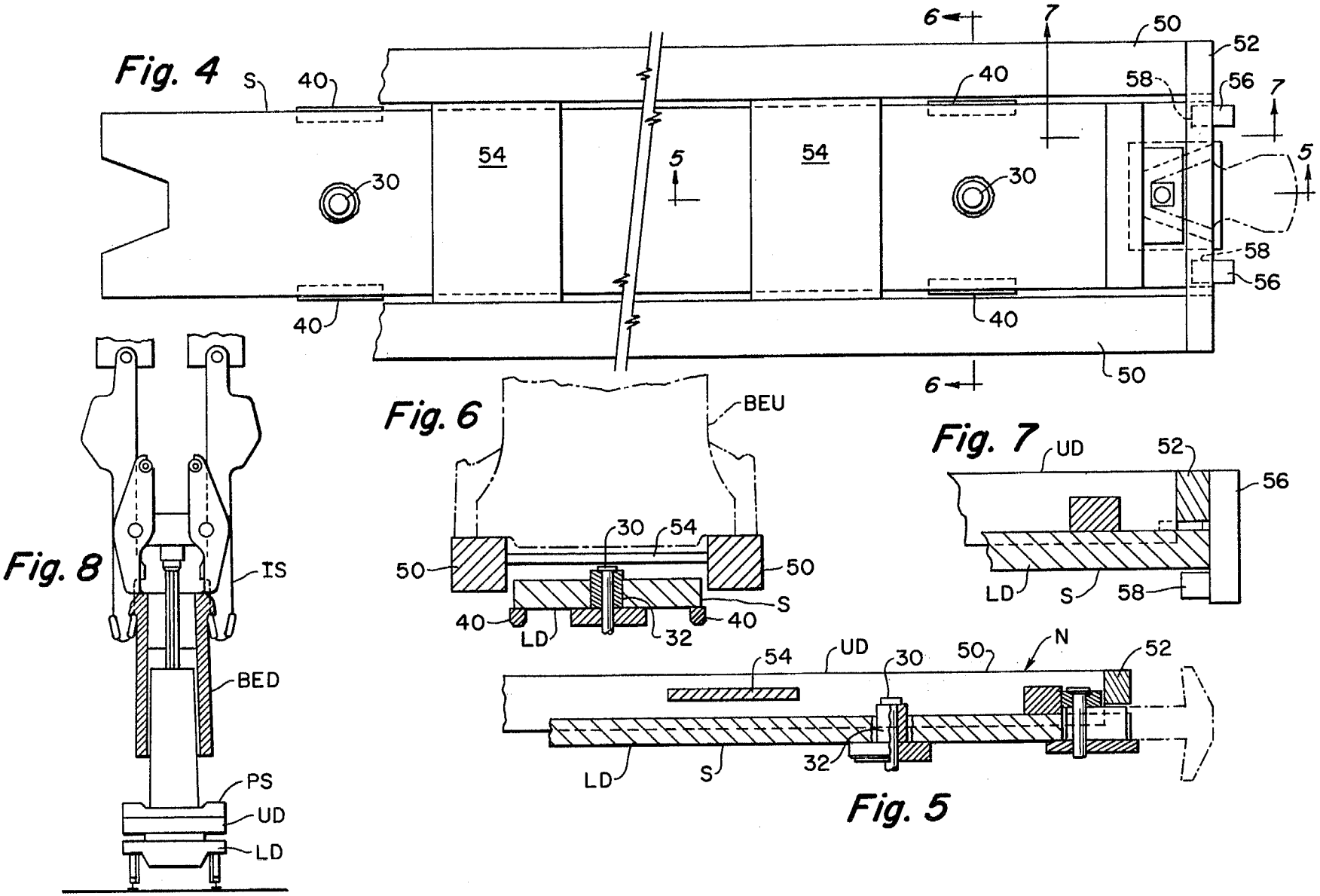
FIG. 4 is a plan view of an ingot buggy frame of this invention.
FIG. 5 is cross-sectional side elevational view of one-half of an ingot buggy frame of this invention, taken along line 5—5 of FIG. 4, the other half is identical but opposite hand to the half shown.
FIG. 6 is a cross-sectional elevational view taken along line 6—6 of FIG. 4.
FIG. 7 is a cross-sectional view taken along line 7—7 of FIG. 4.
FIG. 8 is a schematic representation of an ingot stripper shown in conjunction with a big-end-down ingot mold.

In FIG. 1, there is shown the frame construction comprising part of a prior art ingot buggy IB-0. The ingot buggy IB-0 comprises a single deck 10 defined by plate 12 and support frame 14, which is of lattice type construction, including longitudinal beams 13 and transverse beams 15 and reinforcing bars 16. The support frame 14 is pivotably fastened to a pair of truck assemblies 18 through king pins 20 extending through center thrust bearings 22. It will be noted that the components of the deck 10 are fastened, as by welds, to form a rigid and unitized construction. Consequently, the force from any impact loading, such as that which may occur upon dropping of an ingot mold and a contained ingot, will be transmitted with very little diminution to the center thrust bearings 22 and then to the springs of the truck assemblies 18, the compression of which must take up most of the energy of the impact. Eventually, if the loading is great enough to compress the springs solid and such impact loadings are repeated, the springs, bearings and other components of the buggy will be broken or deformed.

DESCRIPTION OF PREFERRED EMBODIMENTS

The present invention obviates the problems attendant with the rigid deck construction of prior art ingot mold buggies, particularly those which are subjected to vertically imposed impact shock loading such as that caused by the dropping of a mold thereon.

Referring to FIG. 5 of the drawing, there can be observed the two deck construction of the present invention. There is shown ingot mold buggy N comprising upper deck UD and lower deck LD. The lower deck LD is connected to conventional truck assemblies 18 (as shown in FIG. 1) by means of king pins 30 extending through center thrust bearings 32.

The upper deck UD which by virtue of its elastic deflection absorbs a portion of the shock of impact loading from the dropped ingot-mold combination before transmitting it to the slab LD comprises a pair of parallel and mutually facing longitudinal members 50 joined together by cross-members 52 which rest on the lower deck LD, preferably near the ends thereof. Additional cross-ties 54 may be provided between members 50. However, such cross-ties 54 in a preferred arrangement should be spaced from the lower deck LD to avoid detracting from the flat spring relationship between the decks.

The lower deck LD is preferably and principally comprised of a relatively massive slab S, typically five inches thick, which forms a platform for supporting the upper deck UD and for absorbing a portion of the shock of impact loading transmitted from the upper deck through the lower deck to the thrust and journal bearings of the truck assemblies 18 by virtue of its elastic deflection. Most preferably, the slab S is comprised of a single unitary mass. Optionally, the stabilizer bars 40 may be provided on the underside of slab S to limit the degree of tilting of upper deck UD such as might be encountered by off-center loading on upper deck UD.

A feature of the upper deck is that the members 50 are outboard of lower deck LD. Therefore, any impact force on members 50 will be partly reduced by the elastic deflection of these members 50. To further enhance the energy absorption the members 50 are massive in cross-section, e.g., for a buggy of twenty feet in length, designed to carry four ingots weighing ten tons each in molds which weigh twelve tons each, the members 50 are preferred to be 10×10 inches in cross-section and spaced about 3 feet apart. However, it will be understood that these members 50 need not be of constant cross-section.

The upper deck UD may also be provided at its ends with restraining members 56 which serve to limit longitudinal movement of members 50 in respect to the lower deck LD. The restraining members 56 may be additionally provided with hook portions 58 which extend to the underside of, but vertically spaced away from, slab S and thereby limit the rotational movement of the ends of upper deck UD to a degree corresponding to the clearance between slab S and the hook portions 58.

In FIG. 6 there is shown in phantom lines a big-end-up ingot mold BEU illustrating the manner in which it is supported directly on the longitudinal extending support members 50.

FIG. 8 illustrates the manner in which the pouring stool PS of a big-end-down ingot mold BED is supported on the support members 50. FIG. 8 also illustrates schematically the action of an ingot stripper IS which is well known.

From the foregoing description it will be observed that there is provided a buggy for transporting ingot molds and ingots, which buggy comprises a plurality of decks in a novel arrangement wherein the deck frames are free to move, but to a limited extent, in respect to each other in the same mode as a double elliptic flat spring is used in trucks or automobiles. The construction provides means by which vertical components of impact forces are substantially diminished before they can be transmitted to the support bearings of the buggy assembly and cause premature irreparable damage. A feature which contributes to minimizing the transmission of the impact force is that of having an upper deck that overhangs a lower support deck such that it has load support surfaces outboard of the lower deck. Although only two decks have been illustrated it will be understood that more than two decks with each upper deck being free to move in respect to a lower deck may be used.

What is claimed is:

1. In a buggy for transporting ingot molds, which buggy includes:

truck frame structure which carries the wheels and bolster assemblies of the buggy, for a first deck structure superimposed on said frame structure and joined thereto by means of king pins extending through thrust bearings, the improvement which comprises:

a second separate deck structure resting on said first deck structure, said second deck structure including a pair of longitudinal extending side members which are cantilevered outboard of said first deck structure and which define loading support surfaces elastically deflectable when subjected to significant vertically imposed impact forces, said side members being joined together near ends of their longitudinal extents by cross-tie structures which provide means for said second deck structure to rest on said first deck structure, and wherein:

the combination of said first and said second deck structures comprise an energy absorbing device which absorbs vertical components of force imposed on said side members.

2. A buggy as described in claim 1, which comprises:

restrain members carried by said second deck in a manner whereby longitudinal movement of said second deck in respect to said lower deck is limited.

3. A buggy as described in claim 2, which comprises:

hook members carried by said second deck and extending beneath said first deck and limiting the vertical movement of the ends of said second deck in respect to said first deck.

* * * * *

UNITED STATES PATENT OFFICE

CERTIFICATE OF CORRECTION

PATENT NO. : 4357125

DATED : November 2, 1982

INVENTOR(S) : Charles C. Gerding and Stephen M. Rechtorik

It is certified that error appears in the above-identified patent and that said Letters Patent are hereby corrected as shown below:

Column 4, line 54, change "for" to --and--.

Column 6, line 3, change "lower" to --first--.

Signed and Sealed this

*Twelfth* Day of *April 1983*

[SEAL]

*Attest:*

GERALD J. MOSSINGHOFF

*Attesting Officer*

*Commissioner of Patents and Trademarks*